US005301944A

United States Patent [19]

Koehler

[11] Patent Number: 5,301,944

[45] Date of Patent: Apr. 12, 1994

[54] GOLF CLUB HEAD WITH IMPROVED SOLE

[76] Inventor: Terry B. Koehler, 122 Lehmann, Boerne, Tex. 78006

[21] Appl. No.: 4,530

[22] Filed: Jan. 14, 1993

[51] Int. Cl.[5] ..... A63B 53/04

[52] U.S. Cl. ..... 273/167 A; 273/174; 273/77 A; 273/169

[58] Field of Search ..... 273/167 R-77 A, 273/77 R, 164.1, 194 R, 194 A, 187.4, 186.1, 80 C

[56] References Cited

U.S. PATENT DOCUMENTS

| | | | |
|---|---|---|---|
| 1,541,126 | 6/1925 | Dunn | 273/167 A |
| 1,617,090 | 2/1927 | Worthington | 273/167 A |
| 3,079,157 | 2/1963 | Turner | 273/167 A |
| 3,810,631 | 5/1974 | Braly | 273/167 A |
| 3,897,065 | 7/1975 | Solheim | 273/167 A |
| 4,653,756 | 3/1987 | Sato | 273/169 X |
| 4,854,580 | 8/1989 | Kobayashi | 273/77 A |
| 4,895,367 | 1/1990 | Kajita et al. | 273/77 A |

FOREIGN PATENT DOCUMENTS

| | | | |
|---|---|---|---|
| 2194737 | 3/1988 | United Kingdom | 273/77 A |

OTHER PUBLICATIONS

"Golf World", Magazine, Jun. 13, 1972, issue, p. 25.

*Primary Examiner*—Vincent Millin
*Assistant Examiner*—Sebastiano Passaniti
*Attorney, Agent, or Firm*—Gunn, Lee & Miller

[57] ABSTRACT

A golf club head with improved sole portions. Specifically, golf club head (10) having a sole (20) comprised of a leading portion (28) and a trailing portion (30), both portions defining surfaces with positive bounce angles.

21 Claims, 2 Drawing Sheets

PRIOR ART

GOLF CLUB HEAD WITH IMPROVED SOLE

FIELD OF THE INVENTION

This invention relates to a golf club head with an improved sole portion, more specifically, to a golf club head with a leading edge and a trailing edge portion comprising the sole portion, both portions having a positive bounce angle.

BACKGROUND

In the game of golf, club design has evolved such that specialized clubs are used to play the ball under a variety of different conditions. Specifically, woods are used off the tee and for long fairway shots with clean lies. Irons are used for intermediate range shots with a variety of trajectories. Wedges are used in close around the green and for playing out of sand and "problem" lies. Putters are typically used on the green.

Wedges are designed to play a ball from a variety of different types of lies in close to the green. Typically, they have club face loft angles of between 48° and 65° to provide a high, arcing trajectory to the ball—the higher the loft angle, the higher the trajectory of the ball. The wedge market is characterized, in general, by much more subtle differences between the products than is generally found in comparisons between various putters and irons. Typically, the sole portion of a wedge is designed with bounce—that is, a downward or descending angle between the leading edge where the face meets the sole and the lowest point on the sole. For example, typical prior art sand wedges as set forth in FIGS. 1 and 2 feature either a straight sole (FIG. 1) or a sole with a radius portion (FIG. 2). Here, bounce will be defined as the angle the sole or any portion thereof makes between a plane thereof and a line perpendicular to the vertical axis of the club as defined by the shaft of the club. This is more clearly set forth in FIG. 3*a*. The prior art has heretofore disclosed wedges with sole configurations that comprise a single beveled surface between the leading edge and the trailing edge, which surface has a positive bounce angle (see FIG. 1). Occasionally, all or a portion of this beveled surface may be radiused (see FIG. 2). Still, however, the positive bounce angle remains. Additional sole configurations include that found in U.S. Pat. No. 3,897,065 (Karsten Solheim, 1975). The Solheim sole configuration provides for two beveled surfaces defining an intermediate ridge therebetween. However, while the leading edge portion defines a positive bounce angle, the trailing edge portion provides a negative bounce angle. Additionally, U.S. Pat. No. 4,854,580 (Kobayashi, 1989) discloses a sole configuration with two beveled surfaces—again with a leading edge portion having a positive bounce angle and the trailing edge portion having a negative bounce angle.

The function of bounce is to help the club rebound off the surface on which the golf ball lies. To look at it another way, bounce is to help prevent the leading edge of the club face from digging into the surface on which the golf ball lies, with the resultant loss of force and control. The manner in which this is effected can be seen by reference to FIGS. 1 and 2 which represent prior art. As Applicant defines bounce, it can be seen that both figures illustrate club heads that have positive bounce angles. As the golf club passes through the arc of its swing and the leading edge undercuts the ball, the sole will strike the ground. With a positive bounce angle, the resultant force will urge the club head upward to create a "bounce" off the surface. This action helps prevent the face of the club head digging into the turf with the resulting muffed shot and huge divot torn asunder. However, a paradox exists with sand wedges and the like, in that while bounce helps prevent the wedge from digging in the sand, thereby making it easier to play these shots, it also raises the leading edge of the wedge with respect to the centerline of the ball thus making it more difficult to play tight or close lies from outside of sand traps.

Thus, Applicant's design criteria is to provide for a sole design which places the leading edge as low as possible to the horizontal (and thus provide for easier play from tight lies) but which offers plenty of bounce when playing from sand or lush turf, where maximum bounce is desired.

In addition to providing a sole configuration with plenty of bounce but a low leading edge, Applicant's dual bounce sole configuration allows for a narrow sole. This allows for redistribution of weight so as to raise the center of gravity of the club head.

SUMMARY OF THE INVENTION

This improved playability of Applicant's club is achieved through the creation of a unique "dual bounce sole." Specifically, the dual bounce sole is provided in a sole having two portions. A first portion is defined as that portion between the leading edge and a ridge intermediate between leading edge and the trailing edge. The second portion is defined as that portion between the intermediate ridge and the trailing edge. *Both* portions of the club head define *positive* bounce angles.

In addition to providing for better playability by providing a sole design with surfaces defining two positive bounce angles, Applicant further improves the playability of the club by utilizing a slightly oversize club face to gain a larger impact zone when the face is laid open for sand shots.

In addition to the dual bounce sole configuration of Applicant's present invention, playability is improved with a shorter hosel and narrower sole to facilitate a weight saving which is redistributed to the back of the club head resulting in a higher center of gravity to the club head and thus greater trajectory control on full wedge shots. That is, while both loft and center of gravity affect the flight of a golf ball, on full shots, weight distribution is the more dominant determinant of trajectory. This is one reason why the cavity-back, low center of gravity designs are so prevalent on today's market. Applicant's redistribution of weight from the hosel and sole to the upper part of the blade raises the center of gravity of these wedges. The result of such redistribution is such that the golfer will be able to swing more aggressively in full swing situations with less worry about having a soaring out of control trajectory that may result from a low center of gravity design.

In addition to the "dual bounce sole" of Applicant's present invention, Applicant provides for a club with improved playability in having leading edges along the perimeter of the club face radiused to a higher degree than current market offerings. The increased radius provides for a wedge that is more likely to spread blades of grass rather than cut them, thereby giving the golfer more force control on short, delicate chips and pitches, particularly from thick or wet grass.

Applicant's unique dual bounce sole is intially provided in a pitching wedge having an angle of approximately 52° loft, a sand wedge of about 56° loft, and a special wedge of about 60° loft.

Applicant's pitching wedge provides for about 52° of loft to give the golfer a pure pitching club for shots in the 80- to 105-yard range. The unique dual bounce sole allows the club to be laid open for long sand shots. It features more bounce than most nine irons and "P" irons. Typically, irons now carrying the "P" designation have 47° to 49° of loft, the same loft as a nine-iron had just a decade ago.

Most golfers carry a sand wedge. Typically, sand wedges have 55° to 57° of loft. Better players prefer models with narrower soles and/or reduced bounce, relying on their skill in the sand to make up for any deficiencies in the club itself. Their priority is to get the club under the ball from tight lies. On the other hand, the higher handicap golfer tends to choose increased bounce for maximum help in the sand and therefore finds the club practically useless on a fairway or anywhere they would encounter a tight lie.

Applicant's sand wedge with the dual bounce sole allows the leading edge to stay close to the ground when set squarely behind the ball for shots in tight lies, making the club function like a high loft pitching wedge when necessary. On the other hand, when in the sand, laying open the face quickly delivers to the golfer as much bounce as he desires. The sand wedge thus will make a good player better, while giving the higher handicapped golfer an extra club since he currently seldom uses his sand wedge from the fairway.

The special 60° wedge is a relatively new entry to the golf bag collection. Its increased loft is praised for its versatility on short approaches to the green, but present designs generally feature heavy, radiused soles with generous bounce, which is difficult to hit from tight lies or with much more than half-speed swing. Applicant's dual bounce sole with 60° loft should overcome this difficulty. Set squarely behind the ball, the narrow sole can get under the ball even off difficult lies. Opened up slightly, the unique sole makes this wedge very effective from green side bunkers or rough. The higher center of gravity allows a full, aggressive swing without fear of shooting the ball nearly straight up into the sky.

DETAILED DESCRIPTION OF THE PREFERRED EMBODIMENTS

Figure 1:
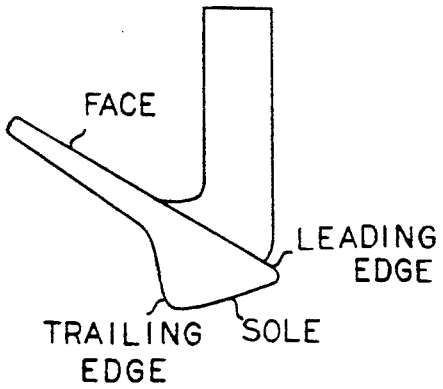
FIG. 1 PRIOR ART
FIGS. 1 and 2 represent side views of typical prior art wedges illustrating the downward slope of the sole from the leading edge to the lowest point of the club head.
Figure 2:
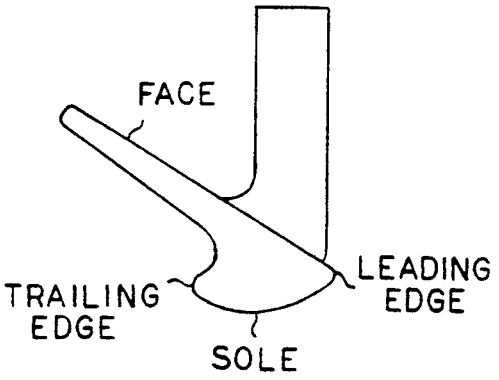
Figure 3A:
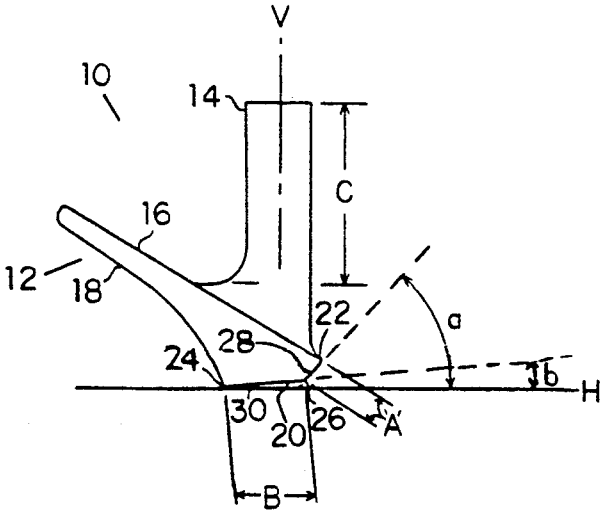
FIGS. 3*a*, 3*b* and 3*c* illustrate cut-away side views from the toe end of the club head of three embodiments of Applicant's present invention illustrating the dual bounce sole.
Figure 3B:
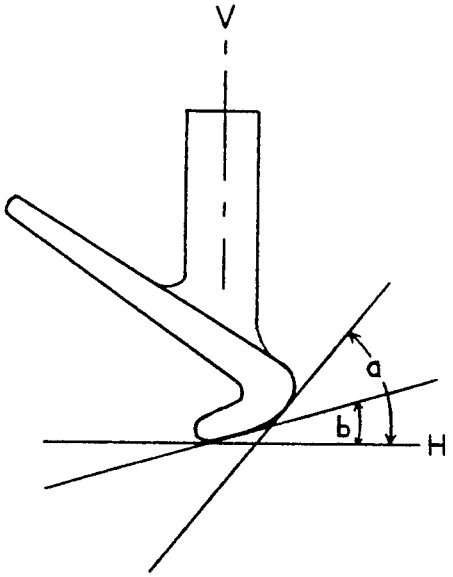
Figure 3C:
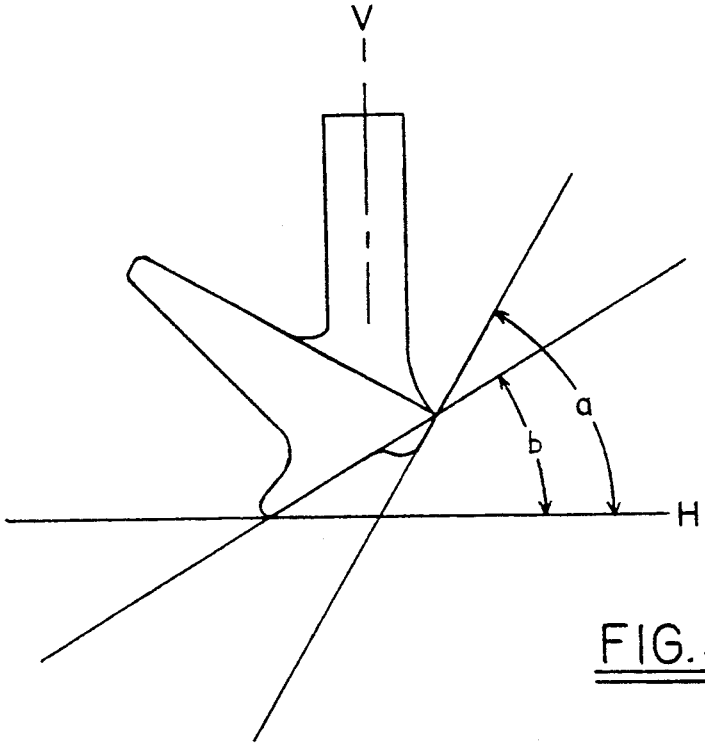
Figure 4:
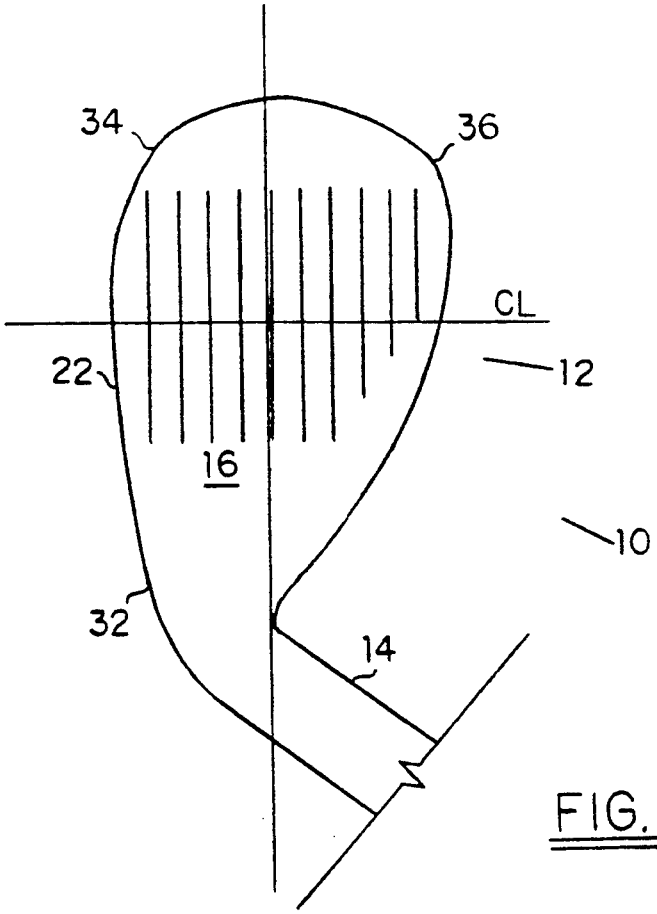
FIG. 4 is a top view of a wedge of Applicant's present invention featuring the novel proportions of Applicant's club head.

FIGS. 3*a*, 3*b* and 3*c* illustrate cut-away side views of three embodiments of Applicant's present invention for a club head having the dual bounce sole. More specifically, FIGS. 3*a*, 3*b*, 3*c* and 4 all illustrate a club head (10) having a blade (12) thereon from which a hosel (14) extends upward. The hosel (14) is for attachment of a shaft (not shown) to blade (12), and blade (12) is the intended striking body for engaging a golf ball (not shown).

Blade (12) has a face (16) thereon. Opposite face (16) is a rear surface (18). At the bottom of the club (as established from the vertical line "V," "V" being coincident with the shaft) lies a sole (20). Sole (20) meets face (16) at a leading edge (22). Sole (20) meets rear surface (18) at a trailing edge (24). A heel portion (32), a toe portion (34) and a perimeter (36) (see FIG. 4) complete the description of structures of a typical golf club head heretofore found in the prior art and in Applicant's invention.

Applicant's novel invention lies in the configuration of sole (20). Specifically, FIGS. 3*a*–3*c* illustrate sole (20) having an intermediate ridge (26) between leading edge (22) and trailing edge (24). Intermediate ridge (26) defines the sole into two portions—a leading edge portion (28) and a trailing edge portion (30). Typically, leading edge portion (28) and trailing edge portion (30) are beveled (see FIGS. 3*a* and 3*c*). In an alternate preferred embodiment as illustrated in FIG. 3*b*, leading edge portion (28) is radiused. Either sole portions could have a convex or concave radius and still define positive bounce angles. As such, such embodiments are intended to be included in Applicant's invention as claims.

Regardless of whether leading edge portion (28) and trailing edge portion (30) are beveled to provide flat surfaces and/or are radiused, they represent two distinct portions, both with positive bounce angles. Moreover, bounce angle "a" of leading edge portion (28) is always positive and always greater than bounce angle "b" of trailing edge portion, which is also always positive.

Table I below sets forth typical bounce angles for leading edge portion (angle "a") and trailing edge portion (angle "b") for the wedges indicated. In addition, Table I below sets forth the width of leading edge portion (28) designated by "A," and "B" designating width of trailing edge portion (30). It is understood that these angles and widths are taken on a centerline bisecting the club face as illustrated by "CL" in FIG. 4. Applicant also provides for a shorter hosel (14) height illustrated by "c" in FIG. 3*a*. Applicant also provides for a width of the sole as measured from the leading edge to the trailing edge at the centerline of the striking face is between 0.35 and 1.00 inch.

TABLE I

| | 52 Wedge | 56 Wedge | 60 Wedge |
|---|---|---|---|
| Bounce ∠ "a" | 18° (12°–45°) | 30° (12°–45°) | 25° (12°–45°) |
| Bounce ∠ "b" | 3° (1°–15°) | 7° (1°–15°) | 6° (1°–15°) |
| Width "A" | .20" (.15"–.65") | .30" (.15"–.65") | .30" (.15"–.65") |
| Width "B" | .20" (.15"–.65") | .30" (.15"–.65") | .30" (.15"–.65") |
| Hosel Height "c" | 2.45" (2.25"–2.75") | 2.50" (2.25"–2.75") | 2.50" (2.25"–2.75") |

Applicant provides in the embodiment illustrated in FIG. 3*c* an intermediate ridge (26) defined in part by a concave trailing edge portion (30). Nonetheless, even with the concave portion of trailing edge portion (30) as illustrated in FIG. 3*c*, the distinctive feature of two positive bounce angles of Applicant's sole configuration is preserved.

Other novel features of Applicant's present invention combined with the unique sole configuration as set forth above include an increased radius of curvature of the leading edge of club head (10). The effect of increasing the radius of the leading edge is to allow the wedge to spread the blades of grass rather than cut across them and thereby give the golfer better control for short, delicate, slow swing pitches, especially from thick or wet grass. Last, Applicant provides as dimension "d" a narrower sole (as measured through midsection "CL" along a straight line from leading edge (28) to trailing edge (30).

The shorter hosel length and narrower sole facilitate a weight savings which is redistributed to the back of the club head, resulting in a higher center of gravity which allows for greater trajectory control on full wedge shots. With the redistribution of weight from the hosel and sole to the upper part of the blade, primarily at the toe section, the effect is to raise the center of gravity. In this manner, and as a result of such redistribution of weight, the golfer will be able to swing with greater club head speed in full swing situations with less worry of having a soaring trajectory.

While Applicant sometimes directs attention to the advantages of the novel sole configuration to wedges, the design advantage carries over into other clubs as well. Specifically and without limit, the dual bounce sole configuration is applicable to all irons, not only wedges. Typically, the irons will have loft angle of between 12° and 65°.

Terms such as "left", "right", "up", "down", "bottom", "top", "front", "back", "in", "out" and the like are applicable to the embodiment shown and described in conjunction with the drawings. These terms are merely for the purposes of description and do not necessarily apply to the position or manner in which the invention may be constructed or used.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

I claim:

1. An improved club head for a golf club, the improved club head comprising:

a metal blade having a striking face, a heel portion and a toe portion and having a hosel to receive a shaft at the heel portion thereof, said metal blade having a rear surface opposite the striking face and a sole, the sole meeting the striking face along a leading edge and the rear surface along a trailing edge, the sole being comprised of a substantially flat leading edge portion and a trailing edge portion, the leading edge portion having a positive bounce angle thereto, the trailing edge portion also having a positive bounce angle thereto, which trailing edge portion bounce angle is less than the bounce angle of said leading edge portion.

2. The club head as described in claim 1 wherein the bounce angle of the leading edge portion of said sole is between 12° and 45°.

3. The club head as described in claim 2 wherein the width of said blade as measured from the leading edge to the trailing edge at the centerline of the striking face is between 0.35 and 1.00 inch.

4. The club head as described in claim 2 wherein the hosel length is between 2.25 and 2.75 inches.

5. The club head as described in claim 2 wherein the leading edge of said blade is radiused.

6. The club head as described in claim 2 wherein the width of said leading edge portion is in the range of 0.15 and 0.65 inch, and the width of said trailing edge portion is in the range of 0.15 and 0.65 inch.

7. The club head as described in claim 1 wherein the bounce angle of the trailing edge portion of said sole is between 1° and 15°.

8. The club head as described in claim 7 wherein the width of said blade as measured from the leading edge to the trailing edge at the centerline of the striking face is between 0.35 and 1.00 inch.

9. The club head as described in claim 7 wherein the hosel length is between 2.25 and 2.75 inches.

10. The club head as described in claim 7 wherein the leading edge of said blade is radiused.

11. The club head as described in claim 7 wherein the width of said leading edge portion is in the range of 0.15 and 0.65 inch, and the width of said trailing edge portion is in the range of 0.15 and 0.65 inch.

12. The club head as described in claim 1 wherein the bounce angle of the leading edge portion is between 12° and 45° and the bounce angle of the trailing edge portion is between 1° and 15°.

13. The club head as described in claim 12 wherein the hosel length is between 2.25 and 2.75 inches.

14. The club head as described in claim 12 wherein the leading edge of said blade is radiused.

15. The club head as described in claim 12 wherein the width of said leading edge portion is in the range of 0.15 and 0.65 inch, and the width of said trailing edge portion is in the range of 0.15 and 0.65 inch.

16. The club head as described in claim 12 wherein the loft of the striking face is between 12° and 65°.

17. The club head as described in claim 1 wherein the width of said blade as measured from the leading edge to the trailing edge at the centerline of the striking face is between 0.35 and 1.00 inch.

18. The club head as described in claim 1 wherein the hosel length is between 2.25 and 2.75 inches.

19. The club head as described in claim 1 wherein the leading edge of said blade is radiused.

20. The club head as described in claim 1 wherein the width of said leading edge portion is in the range of 0.15 and 0.65 inch, and the width of said trailing edge portion is in the range of 0.15 and 0.65 inch.

21. The club head as described in claim 1 wherein the loft of the striking face is between 12° and 65°.

* * * * *